US007922030B2

(12) United States Patent
Waller

(10) Patent No.: US 7,922,030 B2
(45) Date of Patent: Apr. 12, 2011

(54) LID FOR BEVERAGE CONTAINER

(76) Inventor: David B. Waller, Encinitas, CA (US)

( * ) Notice: Subject to any disclaimer, the term of this patent is extended or adjusted under 35 U.S.C. 154(b) by 1729 days.

(21) Appl. No.: 10/996,372

(22) Filed: Nov. 23, 2004

(65) Prior Publication Data

US 2005/0087539 A1 Apr. 28, 2005

Related U.S. Application Data

(60) Continuation-in-part of application No. 09/970,998, filed on Jun. 21, 2000, now abandoned, which is a division of application No. 09/337,451, filed on Jun. 21, 1999, now Pat. No. 6,220,476.

(51) Int. Cl.
*A47G 19/22* (2006.01)

(52) U.S. Cl. ..... 220/719; 220/713

(58) Field of Classification Search ..... 220/713, 220/719, 374, 714; 222/547, 564, 571
See application file for complete search history.

(56) References Cited

U.S. PATENT DOCUMENTS

| | | | | |
|---|---|---|---|---|
| 3,360,161 | A * | 12/1967 | Smith | 220/719 |
| 4,331,255 | A * | 5/1982 | Fournier | 220/257.2 |
| 5,509,568 | A * | 4/1996 | Warden et al. | 220/711 |
| 5,540,350 | A * | 7/1996 | Lansky | 220/380 |
| 5,624,053 | A * | 4/1997 | Freek et al. | 220/713 |
| 6,220,476 | B1 * | 4/2001 | Waller | 220/719 |

* cited by examiner

*Primary Examiner* — Anthony Stashick
*Assistant Examiner* — James N Smalley
(74) *Attorney, Agent, or Firm* — David B. Waller & Associates

(57) ABSTRACT

The present invention is a lid for a beverage container comprising; a top wall having a generally circular periphery, an annular side wall depending from the top wall about its circular periphery, a drinking opening in the top wall adjacent to the circular periphery, an enclosed fluid channel provided in the top wall the channel comprising a fluid path which prevents the direct flow of the beverage from the container through the drinking opening wherein the beverage moving along the fluid path does not rise above the level of the beverage in the container, and an annular mounting portion at the bottom of the side wall for sealingly engaging the lip of the beverage container the lid enabling mobility of the beverage container without spillage of the beverage.

4 Claims, 6 Drawing Sheets

LID FOR BEVERAGE CONTAINER

CROSS-REFERENCES TO RELATED APPLICATIONS

This application is a continuation-in-part of patent application Ser. No. 09/970,998 filed Jun. 21, 2000 now abandoned, which is a divisional application of patent application Ser. No. 09/337,451 filed Jun. 21, 1999 now U.S. Pat. No. 6,220,476.

FIELD OF INVENTION

This invention relates to a lid for the use in combination with a beverage container and more particularly to a lid enabling drinking from the container without removal of the lid and which prevents spillage during use.

BACKGROUND OF THE INVENTION

Beverage container lids adapted to fasten over the rim or lip of disposable beverage containers are well known. Such lids reduce spillage and evaporation of the beverage within the container and help insulate the contents of the container from the external ambient temperature. In their most simple form, such beverage container lids comprise a generally flat lid surface in the form of a disk having a peripheral sealing skirt for securing the lid to the rim of the beverage container. While such lids are entirely suitable for the purposes just described, they must be completely removed in order to gain access to the contents of the container.

This problem has been substantially reduced for cold beverages by providing a selectively opened straw orifice in the lid. This allows access to the contents of the container without removing the lid. Unfortunately, the use of a straw for hot beverages such a coffee or hot chocolate is generally not preferred.

Improved container lids for hot beverages which include an openable tear strip or flap have been devised. See for example U.S. Pat. Nos. 3,868,043, 3,977,559, 4,090,660, and 4,210,272. Such modified beverage container lids offer the advantage of allowing limited access to the contents of the container while still covering most of the open end of the container. However, this type of lid has the disadvantage of providing a direct path from which the beverage in the container can easily spill during use.

Further improvements have been made to the beverage container lids including fold back flaps, see U.S. Pat. Nos. 3,994,411, 4,202,459, 4,322,015, 4,473,167, 4,629,088, 4,738,373, 5,090,584, 5,111,961, 5,183,172, 5,197,624 and 5,613,619. These fold back flaps and various means for securing tear strip or flap in its fully folded back configuration have been provided. For example, U.S. Pat. No. 3,994,411 discloses a container lid having a fold-back flap which includes a pull tab along its outermost edge. The pull tab may be inserted into a slit along the outermost edge of the lid to hold the flap in its fully open position. U.S. Pat. No. 4,202,459 discloses an embossed slot formed in the upper surface of the lid which is able to receive the peripheral skirt of the lid when the flap is fully folded back. Finally, U.S. Pat. No. 4,322,015 discloses a container lid having a fold-back flap which is secured by one or more retainer studs which project upward from the upper surface of the lid. Although each of these designs is workable, there are several disadvantages, in particular, the openable flaps frequently become dislodged from their retaining means and are difficult to hold in the open position. In the case of recloseable flaps, they often do not adequately seal the opening when closed and are difficult to hold in the closed position. Moreover, it is frequently necessary to employ relatively heavy gauge or stiff materials in order to achieve a highly reliable fastening system which is more expensive. Another disadvantage results when the flaps do not tear accurately along the intended line and form sharp edges at each side of the opening thereby formed in the rim or skirt of the container lid which causes discomfort during use. Furthermore, once the flap has been released the lid edges on either side of the opening are difficult to secure to the container lip and do not make an adequate seal allowing the contents of the container to spill from these edges during normal use.

A number of lids have been developed that prevent spillage of the liquid inside the container by utilizing constructions that produce, or create, an anti-siphoning effect such as those described in U.S. Pat. Nos. 2,456,989 and 4,915,250. Unfortunately, these types of lids require the user to apply suction to draw fluid through the drinking opening. While this may be acceptable for cold liquids it can be dangerous if a large volume of hot liquid is inadvertently drawn into the mouth causing scorching.

Another device described in U.S. Pat. No. 4,394,928 is a combination cup and cover that utilizes passages provided in the cover that join with a shelf provided in the container to form an enclosed fluid path from the inside of the container to the drinking opening. Unfortunately, this device requires both the container and the lid to create a functioning fluid path. Neither the lid nor the container can provide spill protection by itself. The major disadvantage of this device is that the lid cannot be used with existing commercially available containers, consequently, the combination container and cover must be sold as a unit not separately.

Consequently, a lid which does not have to be removed from the beverage container, does not suffer from the disadvantages discussed above and significantly reduces or prevents spillage during normal use is needed.

SUMMARY OF THE INVENTION

In accordance with the present invention a lid is provided for a beverage container, wherein the lid comprises: a top wall having a generally circular periphery, an annular side wall depending from the top wall about its periphery, a drinking opening in the top wall adjacent to the circular periphery, a barrier which extends from the annular side wall generally parallel to the top wall to prevent direct flow of a beverage from the beverage container through the drinking opening, and an annular mounting portion at the bottom of the side wall for sealingly engaging the lid of the beverage container enabling mobility of the beverage container without spillage during normal use.

In another embodiment the present invention provides a lid for a beverage container s provided comprising; a top wall having a generally circular periphery, an annular side wall depending from the top wall about its circular periphery, a drinking opening in the top wall adjacent to the circular periphery, an enclosed fluid channel provided in the top wall the channel comprising a fluid path which prevents the direct flow of the beverage from the container through the drinking opening wherein the beverage moving along the fluid path does not rise above the level of the beverage in the container, and an annular mounting portion at the bottom of the side wall for sealingly engaging the lid of the beverage container the lid enabling mobility of the beverage container without spillage of the beverage.

In another embodiment, the present invention provides a lid comprising a top wall having a generally circular periphery, an annular side wall depending from the top wall about its circular periphery, a drinking spout formed in the top wall and along the circular periphery, the spout having a top portion, a sloped side wall extending from the top wall to the top portion, the top portion having a drinking opening, a barrier formed in and perpendicular to the sloped side wall to prevent direct flow of the beverage from the container through the drinking opening, and an annular mounting portion at the bottom of said side wall for sealingly engaging the lid of the beverage container enabling mobility of the container without spillage of the beverage.

In another embodiment, the present invention provides a lid comprising a top wall having a generally circular periphery, an annular side wall depending from the top wall about its circular periphery, a drinking spout formed in the top wall and along the circular periphery, the spout having a top portion, a sloped side wall extending from the top wall to the top portion, and a bottom portion, the top portion having a drinking opening, the sloped side wall having a barrier formed perpendicular to the sloped side wall to prevent direct flow of the beverage from the container through the drinking opening; and the bottom portion having a fluid opening in line with the barrier, and an annular mounting portion at the bottom of said side wall for sealingly engaging the lid of the beverage container enabling mobility of the container without spillage of the beverage.

In still another embodiment of the present invention a lid for a beverage container is provided comprising; a top wall having a generally circular periphery, an annular side wall depending from the top wall about its circular periphery, a chamber formed in the top wall the chamber comprising an upper wall, a lower wall, a perimeter wall and a dividing wall dividing the chamber into two compartments, the upper wall having a drinking opening adjacent to the circular periphery, the lower wall having a fluid entrance opening generally aligned with the drinking opening, the dividing wall having at least one fluid passage opening offset from the fluid entrance opening and the drinking opening such that the fluid path prevents the direct flow of the beverage from the container through the drinking opening wherein the beverage moving along the fluid path does not rise above the level of the beverage in the container; and an annular mounting portion at the bottom of the side wall for sealingly engaging the lip of the beverage container the lid enabling mobility of the beverage container without spillage of the beverage.

In another embodiment of the invention the barrier of the beverage container lid is formed in the shape of an arc the arc having a concave portion and a convex portion wherein the concave portion is directed away from the drinking opening and the convex portion in directed toward the opening.

In another embodiment the bottom portion of the spout is sloped toward the annular side wall and wherein the fluid opening is at the base of the slope.

In other embodiments the lid further comprises a vent hole in the top wall adjacent to the drinking opening; may further comprise at least three stacking ridges extending upward from the top wall or may further comprise two stacking ridges wherein the drinking spout is positioned between them.

In another embodiment the combination of the lid engaged with a beverage container is provided.

DETAILED DESCRIPTION OF THE INVENTION

Figure 1:
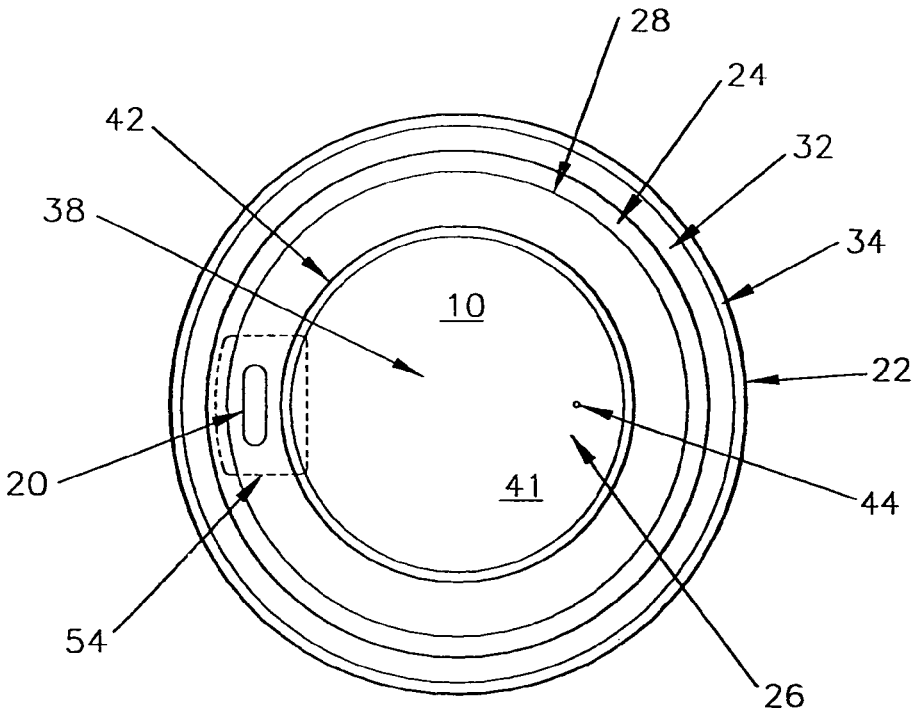
FIG. 1 is a top view of the lid for a beverage container having a generally level top wall and a barrier.

Referring to FIGS. 1 through 10 in detail, the lid 10 provides a cover for a beverage container 12 which inhibits spillage and reduces heat transfer between the beverage and the exterior surrounding atmosphere. Container lids 10 according to the present invention may be fabricated from a variety of materials, which may be formed into the desired configuration (e.g. via vacuum molding). Preferably, the lid 10 is made of one-piece plastic construction, which enables it to be manufactured relatively inexpensively and may therefore be disposable. In addition, one skilled in the art could identify obvious variations of the present invention that would provide manufacturing the lid 10 in more than one piece for assemblage prior to distribution or use (see FIGS. 11 through 14). Furthermore, the lid 10 may be constructed of heavier materials and accompanied by a similarly constructed beverage container 12 so that the lid 10 and container 12 are reusable.

Suitable materials include thermoplastics such as for example, high density polyethylene, polyvinyl chloride, polypropylene, polystyrene, acrylonitrile-butadiene-styrene copolymer, polyvinylacetate, polyvinylbutyral, cellulose acetate, cellulose acetate butyrate, cellulose nitrate and the like. Particularly, impact polystyrene and copolymers comprising at least 90 percentage by weight of styrene monomer component is preferred which combines the advantages of low cost, high strength, ease of fabrication, and desirable mechanical properties, such as resilience.

The thickness of the material of the lid 10 is selected to provide satisfactory strength while enabling enough flexibility to facilitate engagement of the beaded lip 16 of the beverage container 12 by the annular mounting portion 18 of the lid 10. The thickness of the thermoplastic material may vary within a relatively wide range, typically being from about 0.8 to 1.2 mm. More specifically, a material in the range from about 0.6 to 1.0 mm is preferred. Also, as noted above, the lid 10 requires a relatively small amount of material, which enables it to be produced economically. Accordingly, if it is desirable that the lid 10 be reusable, it may be constructed of a variety of substantially thicker materials known to those skilled in the art.

The lid 10 maybe secured in place on the container 12 by an annular mounting portion 18 which engages the rim or lip 14 of the container 12. The annular mounting portion 18 includes a resilient annular gripping portion 32 configured to grip the bead 16 on the lip 14 of the container 12. To facilitate mounting of the lid 10 on the container 12 and movement of the gripping portion 32 into gripping engagement with the bead 16, the mounting portion 18 may further include an outwardly flared skirt 34 depending from the gripping portion 32. As the lid 10 is pushed downwardly onto the lip 14 of the container 12, the skirt 34 aids in centering the lid 10 and in deflecting the gripping portion 32 to an open position to enable it to fit over the bead 16.

The container lid 10 may include a plurality of annular channels and annular ridges (not shown in the Figures) which act to reinforce the lid 10 and make it more rigid. The number of such reinforcement channels and ridges is not critical, and the provision of such features is well known the prior art.

Figure 7:
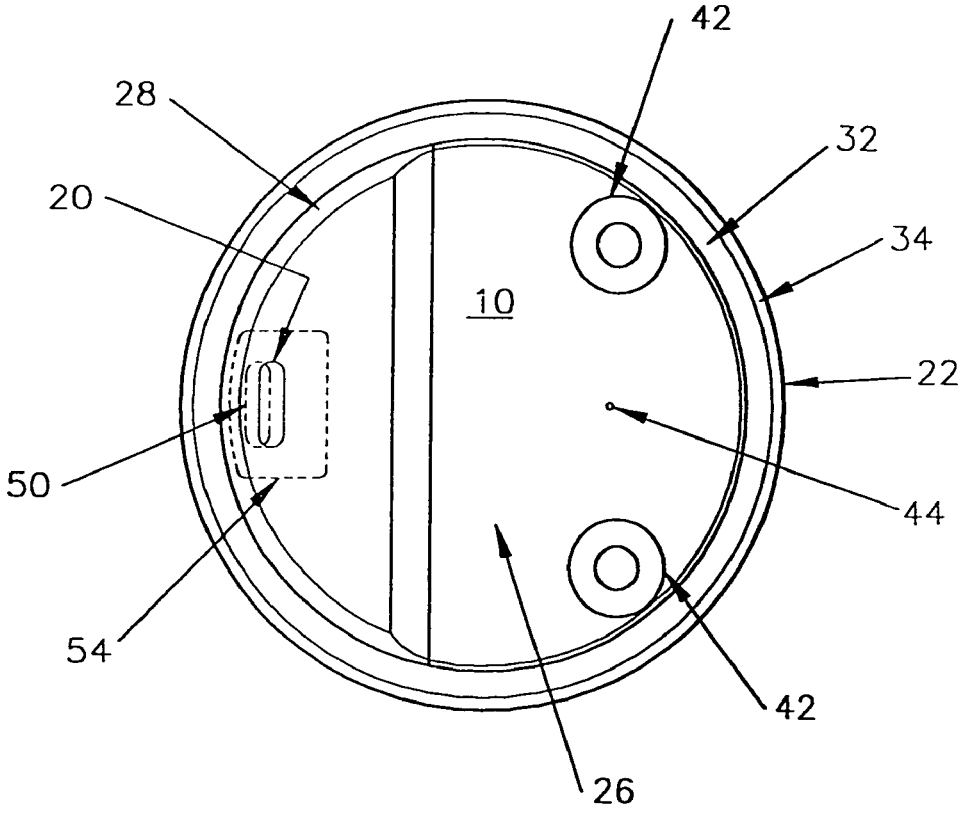
FIG. 7 is a top view of the lid for a beverage container having ridges.
Figure 8:
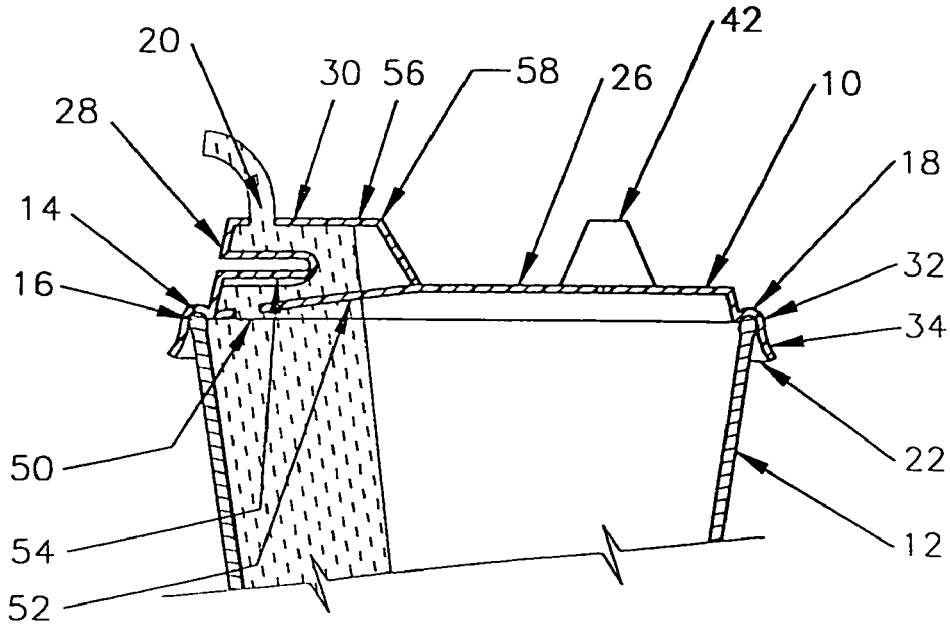
FIG. 8 is a side view of the invention presented in FIG. 7.

In FIGS. 7 and 8 the lid 10 is shown also comprising a plurality of stacking ridges 42. These stacking ridges 42 may be positioned at equal distances from the center of the top wall 26 and at equal distances around the circular periphery. The stacking ridges 42 may be equally spaced around the lid 10 (i.e. equally spaced circumferential). For example, in FIGS. 1 and 2 there could be placed three stacking ridges 42, one to each side of the drinking opening 20 and one adjacent to the drinking opening 20 in the top wall 26, at equal distances from the center of the top wall 26 and spaced such that the stacking ridges 42 permit a second container 12 with lid 10 attached to be stacked one on top of the other with the base of the container resting upon the ridges 42. Correspondingly, in FIGS. 7 and 8 the drinking spout 30 may be equally spaced between two of the stacking ridges 42 such that with their inclusion, a second container 12 with lid 10 attached may be stacked one on top of the other with the base of the container 12 resting upon the ridges 42. Preferably, the lid 10 comprises three stacking ridges 42. Most preferably, the drinking spout 30 and the stacking ridges 42 are of the same height so that the drinking spout 30 may act as the third stacking ridge 42 thereby requiring only two dedicated stacking ridges 42 with the drinking spout 30 having the dual function of a stacking ridge. In addition, the stacking ridges 42 act to provided a level stacking surface for packaging the lids 10 for distribution or affixing to the container 12.

After the vacuum forming operation has been completed the openings 20, 44 and 50 may be formed in the lid 10. The drinking and fluid opening 20 and 50 maybe formed during the molding process or with a punch and die. Alternatively, fluid opening 50 may be formed by puncturing the bottom portion 52 with a pointed tool creating one or more openings sufficiently large enough to allow the beverage in the container 12 to flow into the drinking spout 30.

The vent hole 44, maybe formed in the top wall 26 opposite the drinking opening 20 to enable air to flow into the container 12 as the user drinks from the container 12 to facilitate the flow of the liquid out of the container 12 through the drinking opening 20. The vent hole 44 is preferably smaller than the drinking and fluid openings 20 and 50, and may be formed simply by puncturing the top wall 26 of the lid 10 with a pointed tool.

In FIGS. 3, 4 and 7 through 12, the drinking and fluid openings, 20 and 50 respectively, are provided to enable drinking from the container 12 without removal of the lid 10. In accordance with another embodiment of the present invention, the lid 10 might have scored lines formed in it defining a removable portion to enable a drinking opening 20 to be formed by the user.

In the Figures, the drinking opening 20 is positioned at a distance sufficient to enable the user to drink from the opening 20 without contacting the bottom edge 22 of the lid 10 with his/her lower lip, resulting in discomfort.

Up until this point, the construction of the lid 10 has been conventional. However, the lid 10 includes novel and improved means for preventing spillage of the contents of the beverage container 12 during normal use.

Figure 2:
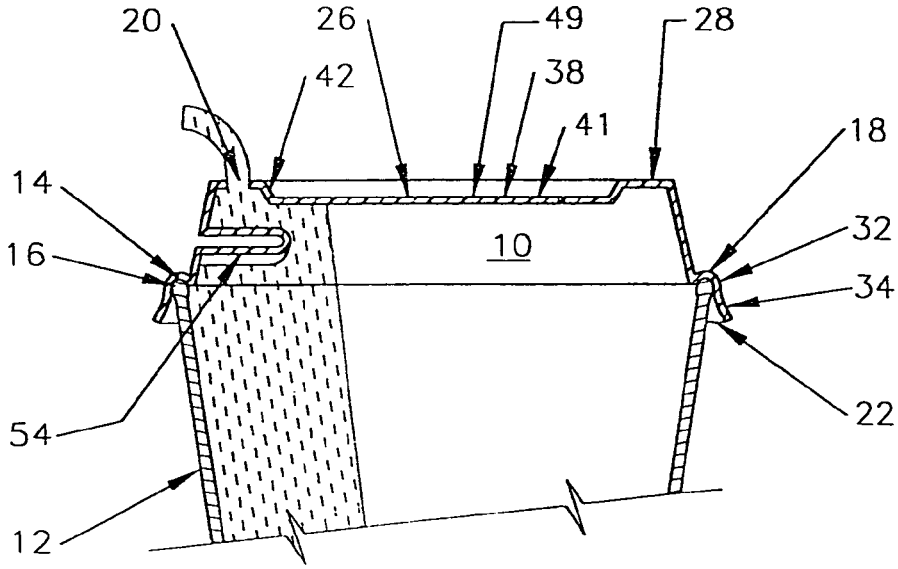
FIG. 2 is a side view of the invention presented in FIG. 1.

In FIGS. 1 and 2 a barrier 54 extends from the annular side wall 28 of the lid 10 generally parallel to the top wall 26 and adjacent to the drinking opening 20 to prevent the direct flow of the beverage from the beverage container 12 through the drinking opening 20. The barrier 54 acts as a wall preventing the beverage from exiting the beverage container 12 without first flowing around the barrier 54. The barrier 54 may be a hollow formed wall or a thin sheet of material adjacent to and having a dimension which is larger than the drinking opening 20. It may be anchored to the annular side wall 28 or to the top wall 26 and the annular side wall 28. Alternatively 2, the barrier 54 may form a chamber larger than and around the drinking opening 20 anchored to the top wall 26 and the annular side wall 28. The chambers side walls may have a single opening, several small openings such as slits grooves, holes, perforations or the like which allow the beverage to enter the chamber and then exit the drinking opening 20 but prevent the beverage from spilling by prohibiting direct flow of the beverage from the drinking opening 20. A variety of shapes may be utilized for the barrier 54, for example, a planar barrier 54 which is parallel to the top wall 26 may be used which is larger that the drinking opening 20. Alternatively, the barrier 54 may be curved in shape, parallel to the top wall 26, and may be oriented such that the concave portion of the barrier 54 faces the internal beverage chamber of the container 12 and the convex portion of the barrier 54 faces the drinking opening 20. This curved shaped will allow any beverage which remains on the barrier 54 to quickly flow to one side of the barrier 54 or the other and be deposited back into the beverage container 12. The barrier 54 could also be curved in shape wherein the concave portion is larger than and facing the drinking opening 20 and angled such that the barrier 54 slopes downward as it extends from the annular side wall 28 thereby allowing any beverage which remains in the concave portion to flow with the slope of the barrier 54 and be deposited back into the beverage container 12.

Figure 4:
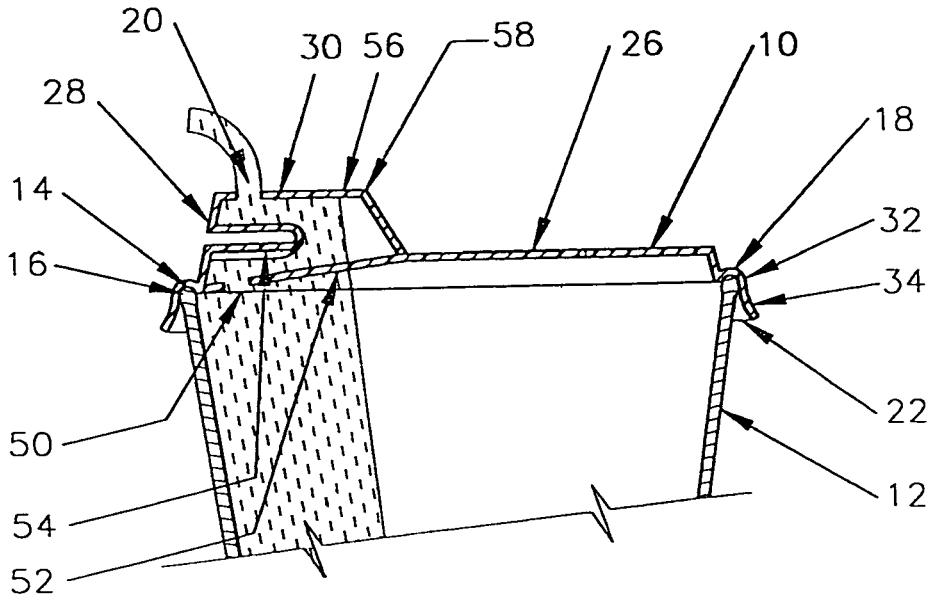
FIG. 4 is a side view of the invention presented in FIG. 3.
Figure 6:
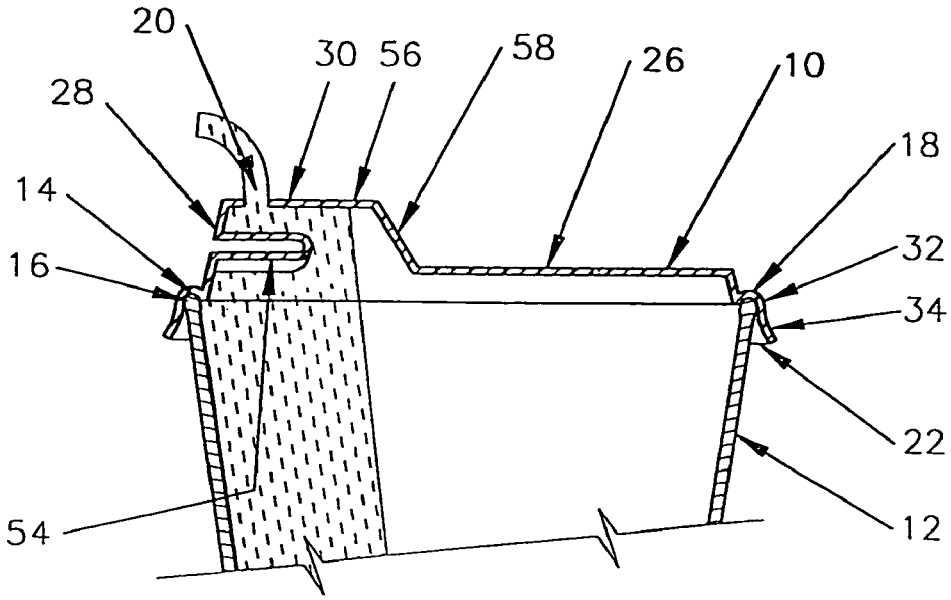
FIG. 6 is a side view of the invention presented in FIG. 5.
Figure 10:
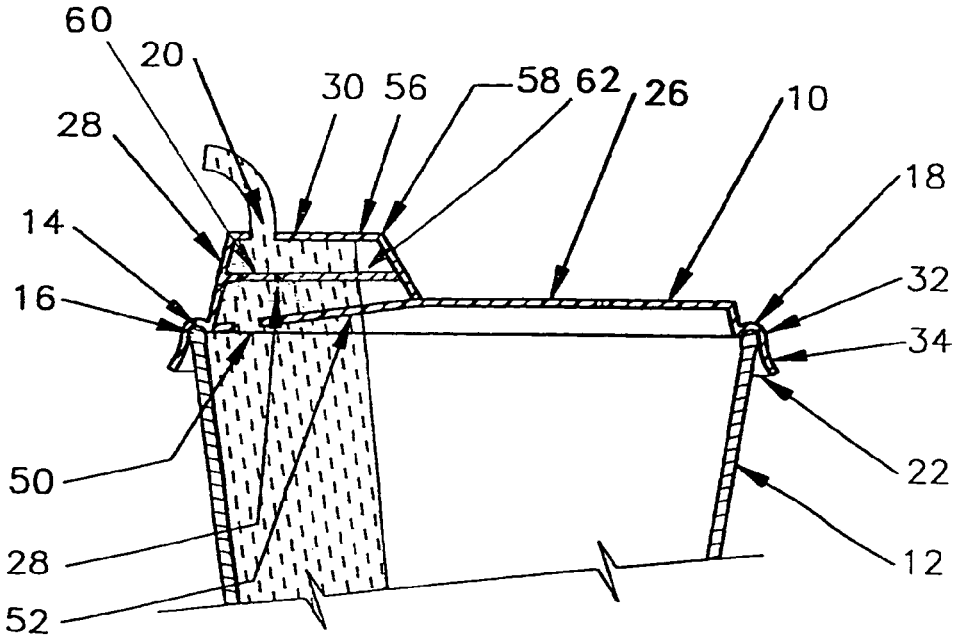
FIG. 10 is a side view of the invention presented in FIG. 9.
Figure 13:
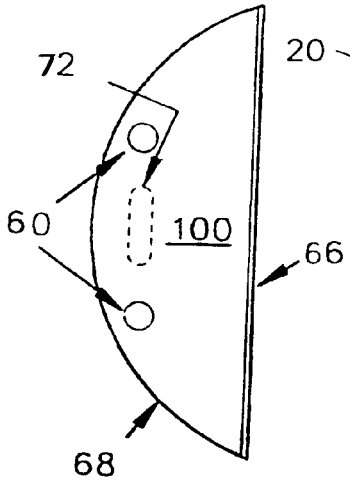
FIG. 13 is a top view of the insert for the lid in FIG. 11.

In another aspect of the invention a fluid channel is provided in the lid 10 comprised of a fluid path to prevent the direct flow of the beverage from the beverage container 12 as can be seen in FIGS. 4, 6 and 10. In general, the fluid channel provides an indirect fluid path that interferes with the beverages direct access to the drinking opening 20 to prevent spillage during use. The channel can be constructed in a variety of configurations. As an example and not by way of limitation, the chamber may have an entrance opening or openings which allows the beverage in the container 12 to enter the fluid channel wherein the beverage travels in the channel then makes a 180 degree turn, continues along the channel and then exits out of the drinking opening 20 thereby preventing direct flow of the beverage from the beverage container 12.

Figure 5:
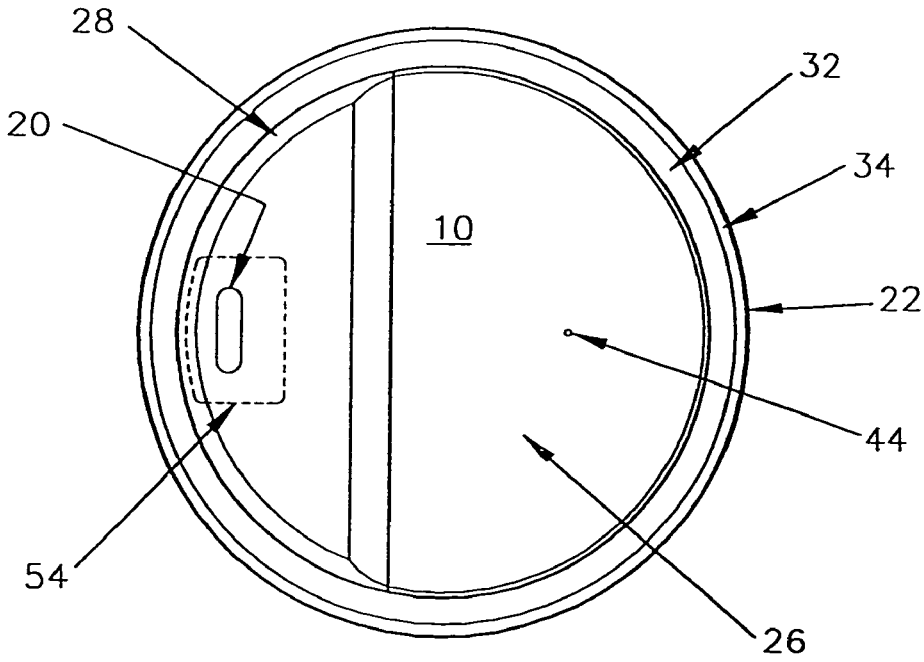
FIG. 5 is a top view of the lid for a beverage container having a spout and a barrier.

In FIGS. 5 and 6 a drinking spout 30 is formed in the top wall 26 and along the circular periphery. The spout may be comprised of a top portion 56 having a drinking opening 20, a sloped side wall 58 which extends from the top wall 26 to the top portion 56, and a barrier 54 formed in and perpendicular to the annular side wall 28. The drinking spout 30 acts as a mouth piece to comfortably accommodate the lips of the user while also allowing the user to drink the beverage through the drinking opening 20 of the lid 10 with little or no contact of the lid 10 with the users nose. The barrier 54 acts as a wall preventing the beverage from exiting the beverage container 12 without first flowing around the barrier 54. The barrier 54 may be a constructed in a variety of different shapes or forms including, for example, a hollow formed wall or a thin sheet of thermoplastic material adjacent to and having a dimension which is larger than the drinking opening 20. It may be anchored to the annular side wall 28 or to the top wall 26 and the annular side wall 28. A variety of shapes may be utilized for the barrier 54 as discussed above.

Figure 3:
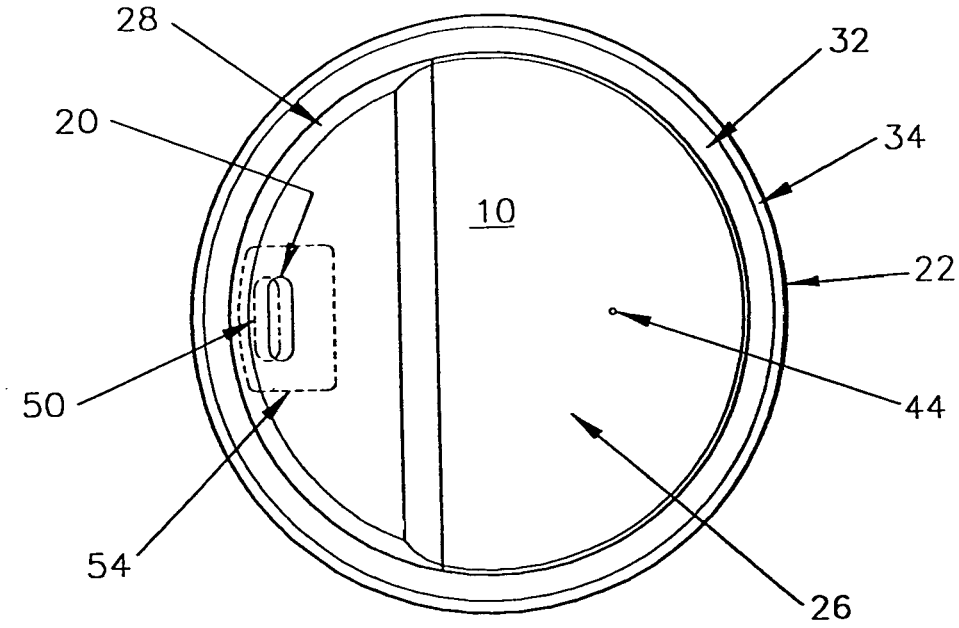
FIG. 3 is a top view of the lid for a beverage container having a chamber comprising a spout and a barrier.

In FIGS. 3 and 4 a drinking spout 30 is formed in the top wall 26 and along the circular periphery as described above, however, the drinking spout 30 defines a chamber comprised of a top portion 56 having a drinking opening 20, a sloped side wall 28 which extends from the top wall 26 to the top portion 56, a barrier 54 formed in and perpendicular to the annular side wall 28 and a bottom portion 52 having a fluid opening 50 in line with the barrier 54. The bottom wall 52 acting to restrict the flow of the beverage from the container 12 into the chamber. The fluid opening 50 of the bottom wall 52 may be a single opening, several small openings such as slits, grooves, holes, perforations or the like which allow the beverage to enter the chamber. The barrier 54 acts as a wall preventing the beverage from exiting the beverage container 12 without first flowing around the barrier 54. The barrier 54 may be constructed in a variety of ways including those discussed above.

Figure 9:
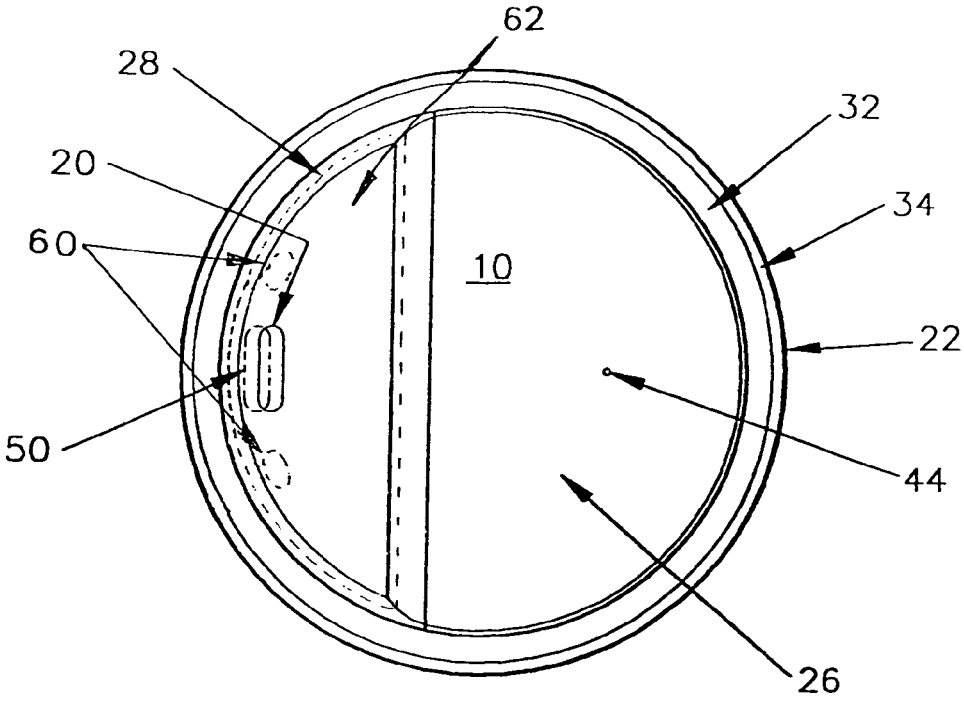
FIG. 9 is a top view of the lid for a beverage container having a fluid channel.

In FIGS. 9 and 10 the lid 10 of the present invention comprises a top wall 26 having a generally circular periphery, an annular side wall 28 depending from the top wall 26 about its circular periphery, a chamber formed in the top wall 26. The chamber is defined by an upper wall, a lower wall, a perimeter wall and a dividing wall 62 dividing said chamber into two compartments, an upper compartment having access to the drinking opening 20 and a lower compartment having access to the fluid entrance opening 50. A drinking opening 20 is provided in the upper wall adjacent to the circular periphery, and a fluid entrance opening 50 is provided in the lower wall generally aligned with the drinking opening 20. The dividing wall 62 has at least one fluid passage openings 60 offset from the fluid entrance opening 50 and the drinking opening 20 such that the fluid path prevents the direct flow of the beverage from the container 12 through the drinking opening 20. The side wall 28 is provided with an annular mounting portion at the bottom of the side wall 28 for sealingly engaging the lip of the beverage container 12. During use the beverage moving along the fluid path does not rise above the level of the beverage in the container 12. In a preferred configuration the lower wall is sloped toward the circular periphery so that fluid remaining in the lower chamber flow back into the container 12. In addition the dividing wall 62 may be arched, concave with respect to the fluid container and convex with respect to the drinking opening, so that fluid remaining in the upper compartment can flow to the lower compartment and eventually back into the fluid container 12.

Figure 11:
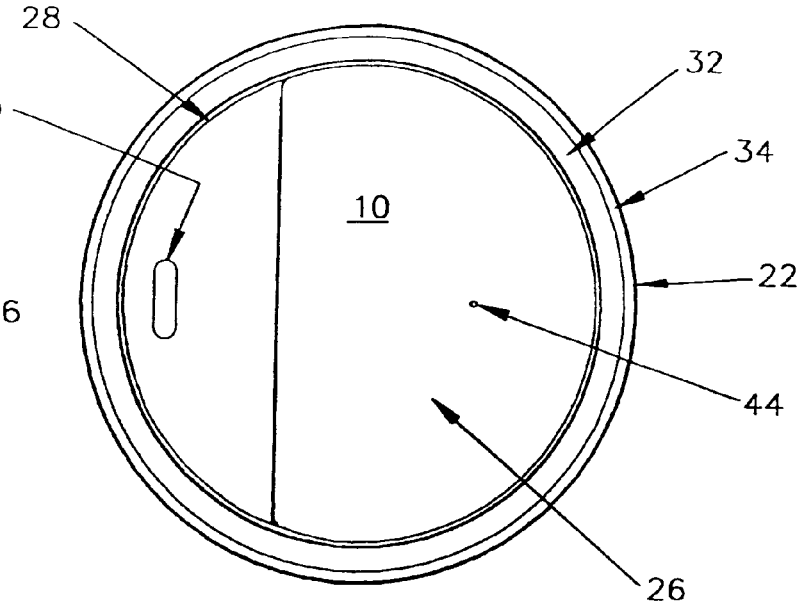
FIG. 11 is a top view of the lid for a beverage container able to receive an insert.
Figure 14:
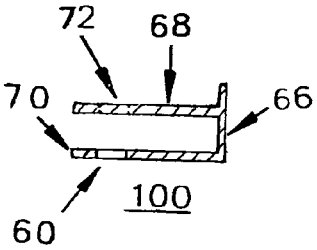
FIG. 14 is a side view of the invention presented in FIG. 13.
Figure 12:
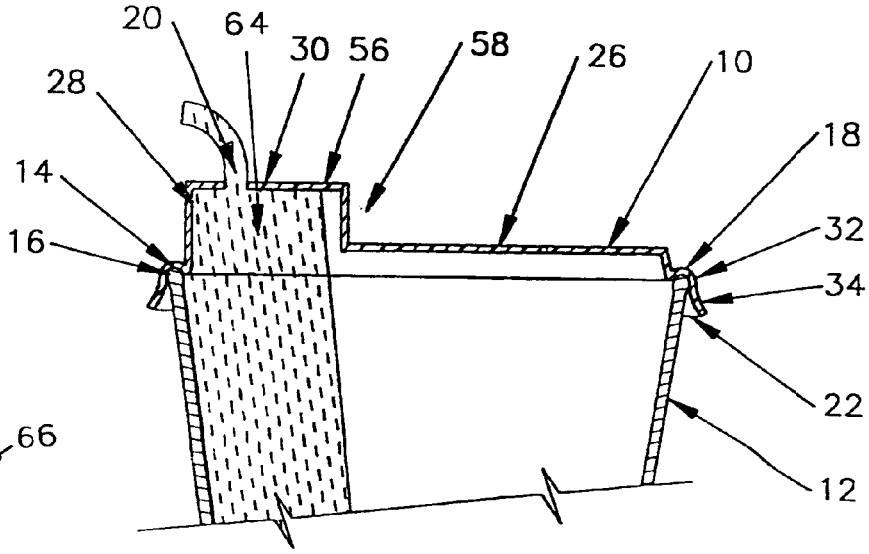
FIG. 12 is a side view of the invention presented in FIG. 11.

In FIGS. 11 and 12 the lid 10 of the present invention comprises a cavity 64 defined by a top portion 56 having a drinking opening 20, a sloped side wall 28 which extends from the top wall 26 to the top portion 56. A fluid flow barrier 100 may be inserted into the cavity 64 to prevent direct flow of the beverage from the container 12 through the drinking opening 20. The fluid flow barrier 100 may be provided in a variety of constructions that may be held within the cavity 64 and provide a barrier or flow channel that prevents fluid from exiting the beverage container 12 without first impacting the fluid flow barrier 100.

In one configuration (see FIGS. 13 and 14) the fluid flow barrier has a side wall 66 having two platforms 68 and 70 extending from and generally perpendicular to side wall 66. The platforms 68 and 70 are positioned on the same side of the side wall 66 and are generally parallel to each other. The first platform 70 is positioned at the base of the side wall 66 and has a fluid entrance opening 72 positioned about the center of the first platform 70. The second platform 68 is positioned just below the top of the side wall 66 and has at least one fluid passage opening 60 positioned off center and out of alignment with the fluid entrance opening 72 of the first platform. The shape of the fluid flow barrier 100 is similar to the shape of internal cavity 64 and when positioned in the cavity 64 forms a generally tight seal. For proper use the fluid flow barrier 100 is oriented so that the second platform 68 enters the cavity 64 first when it is press fit into the lid. The lid is then placed on the beverage container 12. In a preferred configuration the first platform 70 is sloped so that any fluid remaining between the first platform 70 and the second platform 68 will drain back into the container 12. In addition, the second platform 68 may have two fluid passages 60 set evenly apart so that they are positioned to either side of the fluid entrance opening 20 of the first platform 70. In this configuration it is preferable, but not necessary, that the fluid passage openings 60 be positioned at a maximum distance from one another and at the ends of the platform where the platform meets the side wall 66. In addition, it is preferable that the second platform 68 be arched so that any fluid remaining between the second platform 68 and the top portion 56 is directed toward the fluid passages 60 where it can drain to the first platform 70 and then back into the container 12.

In another configuration the fluid flow barrier 100 has a side wall 66 and a single platform positioned at the base of the side wall 66 and has a fluid entrance opening 20 positioned about its center. Preferably the fluid entrance opening 72 is positioned such that when placed in the cavity 64 it is adjacent to the circular periphery of the lid 10. In this configuration the drinking opening 20 is provided on a spout that descends about perpendicular from the top wall 26, generally in the direction of the fluid container 12 when the lid 10 is in place. The length of the spout is less than the width of the sloped side wall 58 of the lid 10. The drinking opening 20 is positioned in alignment with the fluid entrance opening 72. However, while the fluid entrance opening 72 is adjacent to the circular periphery the drinking opening 20 is positioned closer to the center of the lid 10 and off center of the fluid entrance opening 72. In use the fluid flow barrier 100 is inserted into the cavity 64 such that the platform is flush with the top wall 26 when in place. The lid 10 is then placed on the beverage container 12. In a preferred configuration the platform is sloped so that any fluid remaining between the top wall 26 and the platform will drain back into the container 12.

The material used to prepare the fluid flow barrier 100 may be the same material used to prepare the lid 10 or may be form molded from heavier stock plastic.

In general, the invention encompasses a variety of beverage container lids 10 which utilize a barrier 54 or flow channel which prevents direct flow of the beverage from the drinking opening 20 to prevent spillage during use.

A further benefit of the present invention appears to reside in a substantial reduction in the amount of litter attendant to its use. While most lids are often discarded in an uncontrolled and careless manner, the beverage containers themselves tend to be disposed of in a significantly more circumspect and acceptable manner. The problem of container lid litter is so acute that fast food chains and other food and beverage providers prefer not to apply their names or otherwise identify themselves on the container lids employed by their food or beverage product containers. The container lids of the present invention, however, are not normally removed from the containers during use and in preferred embodiments do not contain removable or separable access strips which may be discarded in an unacceptable manner nor are the access strips forming part thereof separable therefrom. Accordingly, the use of the container lids of the invention tend to inhibit the unrestricted disposal of parts thereof or disposal of the lids apart from their corresponding containers. Therefore, adoption of the container lids of the invention could conceivably lead to substantial reductions in the nationwide problem of litter.

The lid 10 described above is particularly suitable for use in a variety of food distribution establishments including fast food franchises, street vendors, airlines, a carry-out counter in a restaurant or any vendor which provides the user with beverages for consumption while the user is in motion. A vendor can fill a container with coffee or the like and apply the lid quickly and simply by snapping it onto the container. The user may then drink from the container while walking or riding in a vehicle without removing or penetrating the lid and without spillage.

Various vibrations and motion tests have been conducted on the container lids of the invention. No spillage occurred under these tests, even under aggravated conditions. Various beverages, such as hot coffee and iced cold water, were tested with the lid in comparison to other currently used lids. The amount of spillage during agitation was eliminated. The thermal state of the beverage was maintained for a similar period with the container lids of the invention secured to the containers.

The preferred embodiments are provided by illustration and not by way of limitation. There is no intent to limit the scope of the invention to this or any other particular embodiment.

What is claimed is:

1. A lid for a beverage container, the lid comprising;

(a) a top wall having a generally circular periphery;

(b) an annular side wall depending from the top wall about its circular periphery;

(c) a chamber formed in said top wall said chamber comprising an upper wall, a lower wall, a perimeter wall and a dividing wall dividing said chamber into two compartments a drinking opening in said upper wall adjacent to said circular periphery, said lower wall having a fluid entrance opening generally aligned with said drinking opening, said dividing wall having at least one fluid passage opening offset from said fluid entrance opening and said drinking opening such that the fluid path prevent the direct flow of the beverage container from the container through the drinking opening wherein said beverage moving along said fluid path does not rise above the fluid in said container, and (e) an annular mounting portion at the bottom of said side wall for sealingly engaging the lid of the beverage container said lid enabling mobility of the beverage container without spillage of the beverage.

2. The beverage container lid according to claim 1 wherein said lid further comprises a vent hole in said top of said top wall opposite said drinking opening.

3. The beverage container lid according to claim 1 wherein said lid further comprises at least three stacking ridges extending upward from said top wall.

4. The beverage container lid according to claim 1 in combination with a beverage container having a generally circular rim with a bead formed thereon able to engage the annular mounting portion of said lid.

* * * * *